US008066021B2

(12) United States Patent
Ma

(10) Patent No.: US 8,066,021 B2
(45) Date of Patent: Nov. 29, 2011

(54) UMBRELLA HINGE

(76) Inventor: Oliver Joen-an Ma, Arcadia, CA (US)

( * ) Notice: Subject to any disclaimer, the term of this patent is extended or adjusted under 35 U.S.C. 154(b) by 77 days.

(21) Appl. No.: 12/365,746

(22) Filed: Feb. 4, 2009

(65) Prior Publication Data

US 2010/0192996 A1 Aug. 5, 2010

(51) Int. Cl.
*A45B 17/00* (2006.01)
*A45B 25/00* (2006.01)

(52) U.S. Cl. ..... 135/20.1; 135/20.3; 135/21

(58) Field of Classification Search ..... 135/15.1, 135/20.1, 20.3, 21
See application file for complete search history.

(56) References Cited

U.S. PATENT DOCUMENTS

| | | | |
|---|---|---|---|
| 2,183,833 | A | 12/1939 | Farhar |
| 2,235,518 | A | 3/1941 | Goshaw |
| 2,475,406 | A | 7/1949 | Russell |
| 2,661,752 | A | 12/1953 | Kampf et al. |
| 2,670,133 | A | 2/1954 | Völker |
| 2,724,396 | A | 11/1955 | Pereira |
| 2,905,187 | A | 9/1959 | Croce |
| 3,120,238 | A | 2/1964 | Glatz |
| 3,145,720 | A | 8/1964 | Torii |
| 3,150,671 | A | 9/1964 | Frey |
| 3,182,673 | A | 5/1965 | Small |
| 3,926,202 | A | 12/1975 | Uthemann et al. |
| 4,582,078 | A | 4/1986 | Ma |
| 4,586,525 | A | 5/1986 | Glatz et al. |
| 4,622,987 | A | 11/1986 | Redl et al. |
| 4,674,523 | A | 6/1987 | Glatz |
| 4,697,606 | A | 10/1987 | Ma |
| 4,878,509 | A | 11/1989 | Tung |
| 5,002,081 | A | 3/1991 | Stromeyers |
| 5,029,596 | A | 7/1991 | Tung |
| 5,086,797 | A | 2/1992 | Earnshaw et al. |
| 5,156,395 | A | 10/1992 | Smith |
| 5,161,764 | A | 11/1992 | Roney |
| 5,349,975 | A | 9/1994 | Valdner |
| 5,499,644 | A | 3/1996 | Geniele |
| 5,584,564 | A | 12/1996 | Phyle |
| 5,611,364 | A | 3/1997 | Woods et al. |
| 5,678,585 | A | 10/1997 | May |
| 5,711,333 | A | 1/1998 | Vanderminden, Sr. |
| 5,735,302 | A | 4/1998 | Saliva |
| 5,785,069 | A | 7/1998 | Glatz |

(Continued)

FOREIGN PATENT DOCUMENTS

CN 2419864 Y 2/2001

(Continued)

OTHER PUBLICATIONS

2005/0183762 (U.S. Appl. No. 11/066,132) and its prosecution history including the Office Action mailed Jul. 13, 2007 and the amendment filed Nov. 13, 2007 (now US 7,533,680).

(Continued)

*Primary Examiner* — David Dunn
*Assistant Examiner* — Danielle Jackson
(74) *Attorney, Agent, or Firm* — Knobbe Martens Olson & Bear LLP

(57) ABSTRACT

An umbrella assembly is provided that comprises a canopy assembly and support rods connected by a hinge assembly. The hinge assembly allows the canopy assembly to alternate between both deployed and folded positions, as well as opened and closed, by a single tension member that can be controlled by an actuation device such as a crank. The hinge assembly can also interlock, stabilizing the canopy assembly.

22 Claims, 11 Drawing Sheets

U.S. PATENT DOCUMENTS

| | | | |
|---|---|---|---|
| D398,443 | S | 9/1998 | Bolle |
| 5,845,665 | A | 12/1998 | Koehn |
| 5,871,024 | A | 2/1999 | Vandermindern, Sr. |
| 5,937,882 | A | 8/1999 | Harbaugh |
| 6,014,980 | A | 1/2000 | Glatz |
| D434,215 | S | 11/2000 | Lin |
| 6,152,156 | A | 11/2000 | Tung |
| D434,556 | S | 12/2000 | Lin |
| 6,220,261 | B1 | 4/2001 | Glatz |
| 6,311,705 | B1 | 11/2001 | Ma |
| 6,435,444 | B1 | 8/2002 | Lin |
| 6,478,037 | B2 | 11/2002 | Tung |
| 6,520,192 | B1 | 2/2003 | Lo |
| 6,575,182 | B2 | 6/2003 | Tung |
| 6,575,183 | B2 | 6/2003 | Tung |
| D477,458 | S | 7/2003 | Goldwitz |
| 6,588,438 | B1 | 7/2003 | Steiner |
| 6,607,002 | B2 | 8/2003 | Reese |
| 6,619,306 | B2 | 9/2003 | Ma |
| 6,662,815 | B2 | 12/2003 | Tung |
| D497,479 | S | 10/2004 | Yu |
| 6,827,094 | B1 | 12/2004 | Bramwells |
| 6,837,255 | B2 | 1/2005 | Bunch et al. |
| 6,840,253 | B2 | 1/2005 | Ma |
| 6,851,823 | B2 | 2/2005 | Bilotti |
| 6,923,193 | B2 | 8/2005 | Chen |
| 6,926,019 | B2 | 8/2005 | Glatz |
| 6,953,043 | B2 | 10/2005 | Yu |
| 6,988,504 | B1 | 1/2006 | Goldwitz |
| D518,629 | S | 4/2006 | Ma |
| 7,134,442 | B2 | 11/2006 | Ma |
| 7,207,343 | B2 | 4/2007 | Earnshaw et al. |
| 7,255,118 | B2 | 8/2007 | Vardy et al. |
| 7,341,068 | B2 | 3/2008 | Liu |
| 7,493,909 | B2 | 2/2009 | Ma |
| 7,533,680 | B2 | 5/2009 | Ma |
| 2002/0083969 | A1 | 7/2002 | Tung |
| 2002/0104557 | A1 | 8/2002 | Tung |
| 2003/0010366 | A1 | 1/2003 | Glatz |
| 2003/0015230 | A1 | 1/2003 | Glatz |
| 2004/0031513 | A1 | 2/2004 | Bunch et al. |
| 2004/0055627 | A1 | 3/2004 | P. Moga |
| 2004/0055628 | A1 | 3/2004 | Yu |
| 2004/0069333 | A1 | 4/2004 | Ma |
| 2004/0182429 | A1 | 9/2004 | Chen |
| 2005/0229957 | A1 | 10/2005 | Glatz |
| 2006/0278262 | A1 | 12/2006 | Ma |

FOREIGN PATENT DOCUMENTS

| | | | |
|---|---|---|---|
| DE | 580503 | | 7/1933 |
| DE | 3229776 | A1 | 4/1983 |
| DE | 3820573 | | 8/1989 |
| DE | 20205561 | | 7/2002 |
| EP | 0392989 | | 10/1990 |
| EP | 1 400 186 | | 3/2004 |
| GB | 22218 | | 0/1911 |
| WO | WO 2005/018369 | A1 | 3/2005 |

OTHER PUBLICATIONS

2005/0183762 (U.S. Appl. No. 11/066,132) and its prosecution history including the Office Action mailed Apr. 14, 2008 and the Amendment filed Sep. 15, 2008. (now US 7,533,680).

2006-0278262 (U.S. Appl. No. 11/324,952) and its prosecution history including the Office Action mailed Jul. 1, 2008. (now US 7,708,022).

EP Search Report re EP App 05255414.4 dated Jun. 28, 2006 (015VEP).

EP Extended Search Report regarding EP App. No. 10250179.8 dated May 6, 2010 in 8 pages (088VEP).

Operation Manual Easy Sun Parasol Sunshade (Issue: Jul. 2004) pp. 1-17.

Page 2 of Treasure Garden's product brochure identified as "AG3 9' Centilever Umbrella".

Notice of Allowance.

UMBRELLA HINGE

BACKGROUND OF THE INVENTIONS

1. Field of the Inventions

This application is directed to a hinge that, when applied to an umbrella, can allow movement of an umbrella canopy extended from a support member.

2. Description of the Related Art

Umbrellas have been developed to provide shelter from the elements and are particularly useful in outdoor seating areas such as a backyard patio. Often, an umbrella has a support pole and a canopy positioned at the top of the pole for providing shade. Basic umbrellas have the support pole centrally located directly beneath the canopy. This construction has several disadvantages. For example, the pole is located at the most sheltered position under the canopy. Also, the pole obstructs the view of persons seated beneath the canopy. Some umbrella designs locate the support pole to the side of the canopy, generally suspending the canopy from above. A disadvantage of these designs is that they take up more space than umbrellas supported from below. A few umbrella designs support a canopy from above and are retractable to reduce the amount of space that they require.

For example, U.S. Pat. No. 7,134,442 ("the '442 patent") (which is incorporated herein by reference in its entirety) describes an umbrella that includes support rods, struts, canopy fabric supported by the struts, and a crank handle. The canopy can be deployed using the crank handle, which can be located at a lower portion of the support rods. As discussed in the '442 patent, the umbrella can thus alternate between various positions to control the location of the shelter provided and to reduce the amount of space required during storage.

Another example of the background art is described in U.S. Pat. No. 6,152,156 ("the '156 patent"). In the '156 patent a hinge is held in position by an anchor that can be wound through a pulley into an anchor room. In the design of the umbrella discussed in the '156 patent, the hinge includes an elbow and a suspension member rotatably coupled to and positioned beneath the elbow. The '156 patent describes the hinge as being secured by virtue of the anchor spanning both the elbow and the suspension member when in the anchor room. When the anchor is withdrawn from this position within the anchor room, the elbow and suspension member are described as being able to rotate relative to each other.

SUMMARY OF THE INVENTIONS

The umbrella design of the '156 patent is disadvantageous in several respects. For example, the hinge described in the '156 patent may not have sufficient stability in all situations. For example, the anchor is the only element preventing rotation of the canopy when in the position depicted in FIG. 3. This may not provide sufficient stability in, for example, windy conditions. Also, such a design would not be strong enough for larger size umbrellas, such as those used in a market to cover a larger area than typical backyard umbrellas.

Further, the use of the anchor and anchor room to couple the two portions of the hinge of the '156 patent may not be reliable. For example, if the anchor is pulled to the anchor room when the hinge is partially rotated the anchor could jam without fully entering the anchor room.

Therefore, there is a need to provide more robust hinge joints for umbrellas. The hinge joint described herein is particularly applicable to suspension (e.g., cantilevered) umbrellas. In some applications, such as large market umbrellas, the hinge joint provides a very robust connection between relatively moveable portions of a hinge joint. Without such a robust connection, the weight of the components on either or both side(s) of the hinge can compromise the strength or performance of the hinge. Thus, the hinge preferably is sufficiently robust to remain intact even when subjected to loads other than its own weight, for example in high wind conditions.

In one embodiment an umbrella assembly is provided that includes a cantilevered beam and an elbow comprising an upper portion coupled with the cantilevered beam. The elbow also includes a lower portion that defines a pathway therethrough and that comprises an elongated pin-slot. A fork that comprises first and second tines is disposed adjacent to opposite sides of and rotatably and translationally coupled to the lower portion of the elbow by a pin disposed between said tines and within said elongated pin-slot. The fork defines a pathway therethrough. The umbrella assembly also includes a locking device for limiting the translation and rotation of the fork relative to the elbow. The locking device comprises a stop projection, a stop projection-receiving portion, a wedge-shaped recess, and a wedge shaped projection. The stop projection is disposed on the lower portion of the elbow. The stop projection-receiving portion is disposed on the fork and aligns with the stop projection when the pathways are aligned. The wedge shaped recess is disposed on the lower portion of the elbow and the wedge-shaped projection is disposed on the fork that aligns with the wedge-shaped recess when the pathways are aligned. The umbrella also includes an elongated pulling member and a canopy assembly The pulling member passes through the pathways of the elbow member and the fork and the canopy assembly is coupled with an end of the pulling member. Translation of the pulling member actuates the canopy assembly from a closed position to an open position and moves the stop projection into the stop projection-receiving portion. Translation of the pulling member moves the wedge shaped projection into the wedge-shaped recess to engage the locking device.

In another embodiment, an umbrella assembly is provided that comprises a cantilevered beam, a first hinge member coupled with said beam, and a second hinge member coupled with the first hinge member. The first hinge member comprises a laterally extending projection. The second hinge member comprises a void that has a shape corresponding to that of the projection and that faces the projection. The umbrella assembly has a first position in which the laterally extending projection and the void are disengaged permitting relative movement between the first and second hinge members and a second position in which the laterally extending projection and the void are engaged preventing such relative movement.

In another embodiment, a cantilevered umbrella assembly includes a cantilevered beam, a canopy assembly, and a joint disposed between the canopy assembly with the beam. The canopy assembly is coupled with the cantilevered beam. The joint allows both translational and rotational movement of the canopy assembly relative to said beam between a locked position and an unlocked position, wherein the joint is stabilized in the locked position by at least two distinct locking mechanisms that limit rotation and that limit translational movement to only one direction.

In some embodiments, an umbrella hinge includes upper and lower hinge portions that interconnect with at least one of upper and lower locking mechanisms. An embodiment of an upper locking mechanism includes a plurality of side projections disposed on the upper hinge portion and a corresponding plurality of recesses disposed on the lower hinge portion adapted to slide toward and receive the side projections. An embodiment of a lower locking mechanism includes a ramped projection and a sloped recess. The ramped projection and sloped recess are adapted to be interengaged to provide a locking function.

In one embodiment, an umbrella assembly is provided with an alignment device adapted to provide for alignment between upper and lower hinge portions. In one embodiment, the lower hinge portion is adapted for translational and rotational movement relative to the upper hinge portion. An alignment device is disposed between the upper and lower hinge portions to provide optimal orientation of the upper and lower portions. Such alignment can be achieved by bringing a wedge-shaped projection into engagement with a recess of corresponding shape. The wedge-shaped projection can be disposed on the lower or upper hinge portion and the recess can be disposed on the other of the upper and lower hinge portion. The alignment device can provide for proper engagement, e.g. by aligning passageways for a tension member adapted for deploying the umbrella or by aligning locking features disposed on the upper and lower hinge portions.

BRIEF DESCRIPTION OF THE DRAWINGS

Some preferred embodiments of the invention will now be more particularly described by reference to the accompanying drawings, in which:

FIGS. 6A-9A depict cross-sectional views of the hinge assembly of FIG. 1A in various positions taken at a section plane corresponding to the section planes 3-3 and 5-5;

FIGS. 6B-9B depict side views of the hinge assembly of FIG. 1A in the positions of FIGS. 6A-9A;

FIGS. 7C-9C depict the umbrella assembly of FIG. 1 in positions corresponding to the positions of the hinge of FIGS. 7A-9A;

DETAILED DESCRIPTION OF THE PREFERRED EMBODIMENTS

This application is directed to umbrellas and couplings, such as hinges, that can be used in umbrellas to selectively provide for relative movement of components that are coupled thereby and to securely connect such components to prevent such relative movement when desirable. As discussed further below, the couplings in one embodiment provide a first configuration that allows movement in at least one plane (depicted as a plane in which a supporting cantilevered beam extends) and a second configuration in which multiple securement devices are engaged to prevent such movement. Further, it will be clear from the discussion below that the couplings described herein can have applications in mechanical apparatuses beyond umbrellas. Various embodiments of such hinges are described below, in connection with the figures.

Figures 1, 1A:
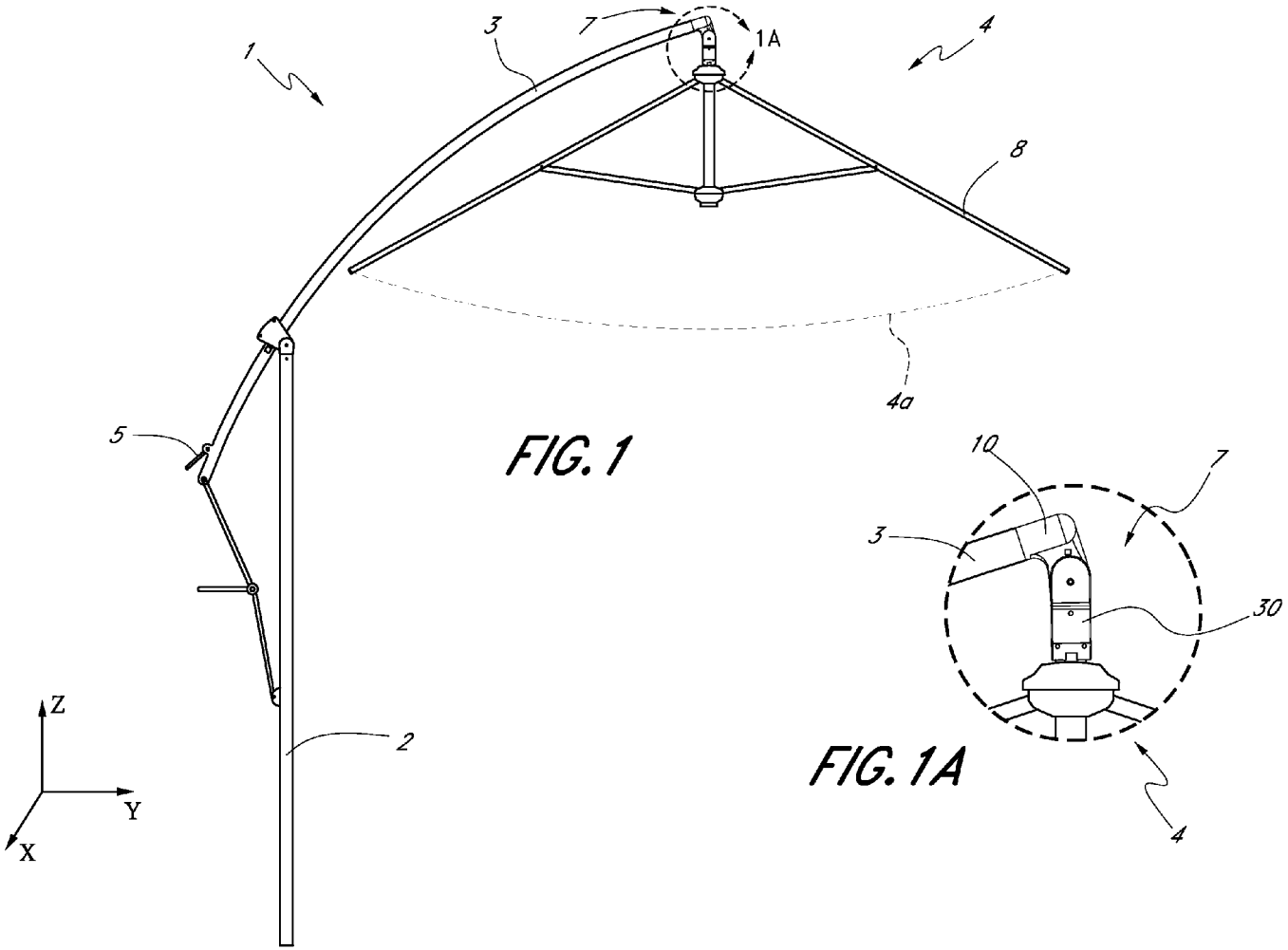
FIG. 1 depicts a plan view of an umbrella assembly in an open, deployed position.
FIG. 1A depicts an enlarged view of a hinge assembly on the umbrella assembly of FIG. 1.

FIG. 1 depicts one embodiment of an umbrella assembly 1. The umbrella assembly 1 can include first and second support rods 2, 3. The first support rod 2 can act as or be coupled with a base for the umbrella assembly 1. In various embodiments, the first support rod 2 includes or is coupled with a weighted bottom, physical attachment, or some other restraining mechanism. One embodiment of a base with which the umbrella assembly could be coupled is described in U.S. application Ser. No. 11/357,514, entitled Umbrella Base Clamp, which is hereby incorporated by reference herein. The second support rod 3 can be coupled with the first support rod 2 in a retractable manner, as will be discussed later. Further, the second support rod 3 can be configured as a cantilevered beam in some embodiments. In other embodiments, the support rods 2, 3 can be rigidly attached, unitary, or have some other form. The support rods 2, 3 can take any form, including being solid or hollow in some embodiments, e.g., configured as poles with circular or non-circular configurations. In other embodiments, the support rods 2, 3 can include a plurality of flanges coupled together, similar to an I-beam.

The umbrella assembly 1 can further include a canopy assembly 4 located near an end of the second support rod 3. As depicted, the canopy assembly 4 can include a canopy fabric 4*a* (shown schematically in FIG. 1) and canopy struts 8 that can open and close using mechanisms such as those described in the '442 patent, incorporated herein by reference in its entirety.

A hinge assembly 7 can be positioned between the canopy assembly 4 and the second support rod 3, for example to directly couple the canopy assembly 4 to the support rod 3. In some embodiments, the hinge assembly 7 indirectly connects the canopy assembly 4 to the support rod 3, for example through an intermediate member. As is discussed further below, the hinge assembly 7 is further configured to allow the canopy assembly 4 to move relative to the support rod 3. The movement of the canopy assembly 4 can be controlled by an actuation device 5. The actuation device 5 can take any suitable form and is depicted herein as including a crank as shown in FIG. 1. In some embodiments, the actuation device 5 can be located remotely from the canopy assembly 7. For example, the actuation device 5 can be configured to control the canopy assembly 7 via a tension member 6, as shown in FIGS. 6-10.

The hinge assembly 7 permits some translational movement and some rotational movement of the canopy assembly 4 relative to the second rod 3. In some embodiments, the hinge assembly 7 permits upward translational movement of the canopy assembly 4 during the opening of the canopy assembly 4 and downward translational movement as the canopy assembly 4 is closed. The hinge assembly 7 can also permit some rotational movement of the canopy assembly 4 relative to the support rod 3, depending on the angular position of these structures.

In one embodiment, the hinge assembly 7 can include a pin-in-slot joint (also shown and further described below in connection with FIGS. 6-9). The hinge assembly 7 can further include a first hinge portion 10 and a second hinge portion 30, which can be connected by the pin-in-slot joint. In one embodiment, the first hinge portion 10 is coupled with the second support rod 3. FIG. 1A shows that the first hinge portion 10 can be directly attached to the second support rod 3. In one embodiment, the second hinge portion 30 is coupled with the canopy assembly 4. FIG. 1A shows that the second hinge portion 30 can be directly attached to the canopy assembly 4. The first and second hinge portions 10, 30 can rotate relative to each other, allowing the canopy assembly 4 to rotate relative to the second support rod 3, as will be described further below.

Figure 2:
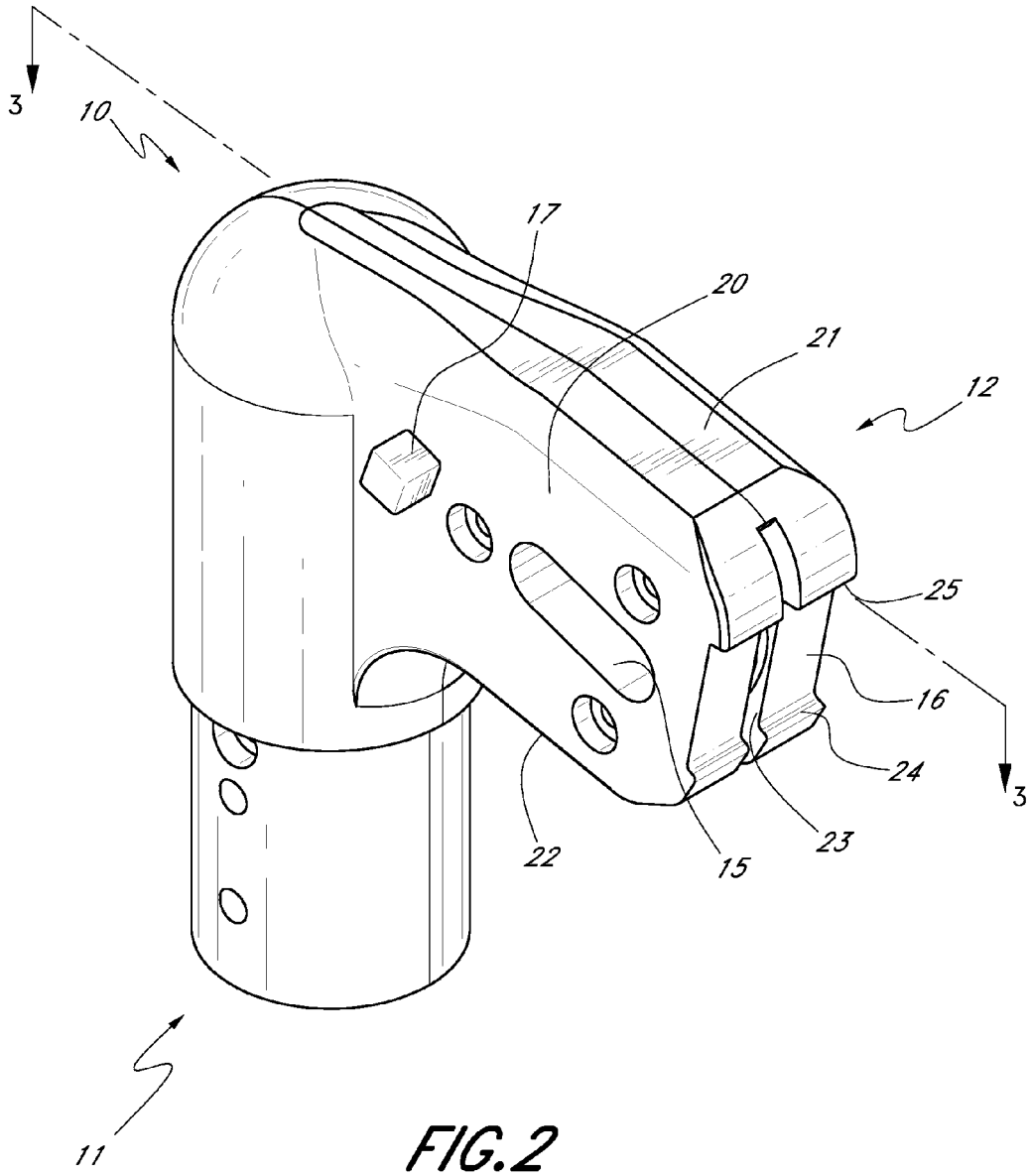
FIG. 2 depicts a perspective view of a first hinge portion of the hinge assembly of FIG. 1A.
Figure 3:
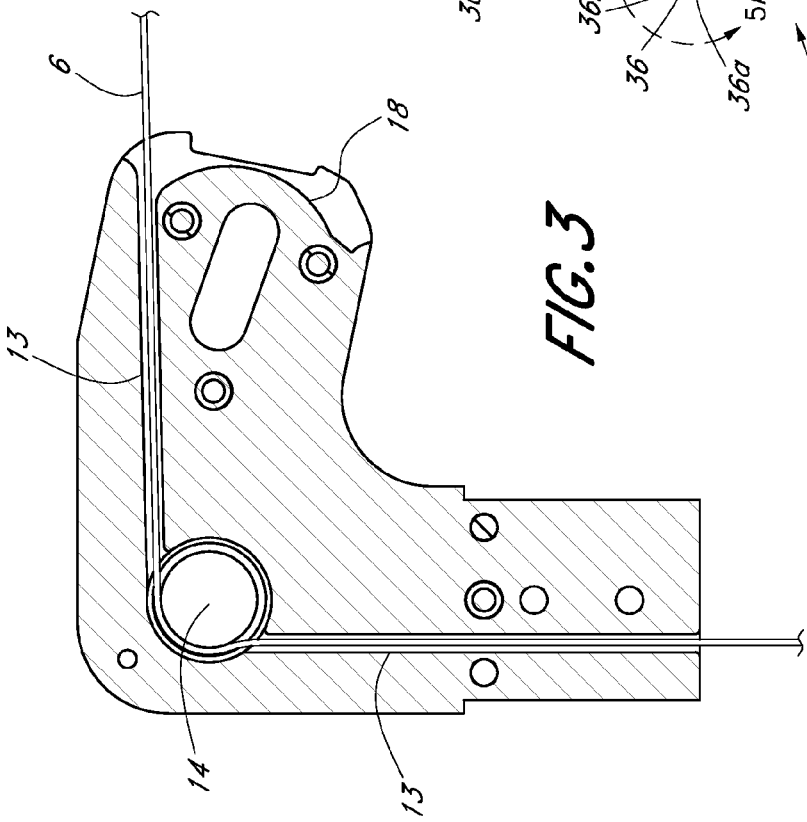
FIG. 3 depicts a cross-sectional view of the first hinge portion of FIG. 2 taken at section plane 3-3.
Figure 4:
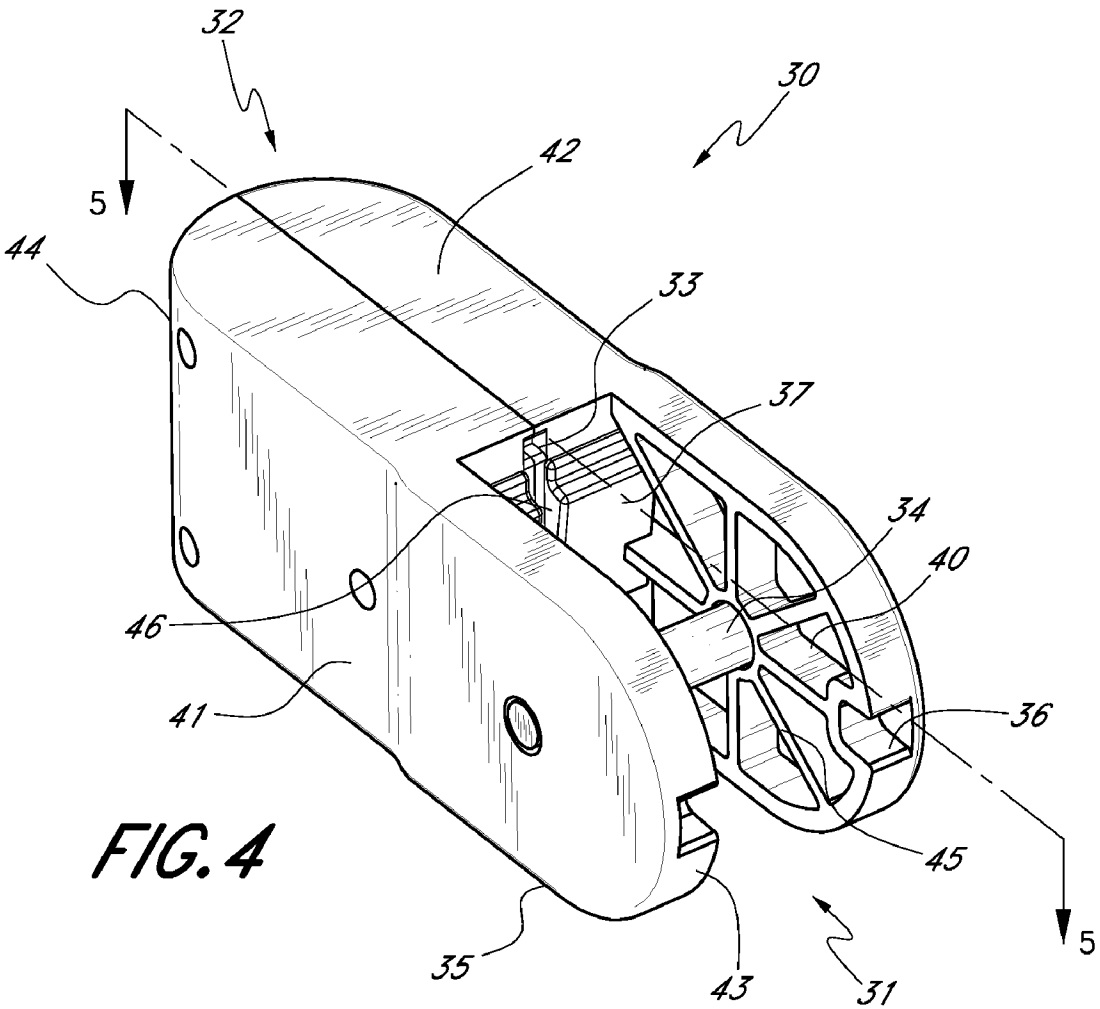
FIG. 4 depicts a perspective view of a second hinge portion of the hinge assembly of FIG. 1A.

As depicted in FIGS. 2-4, the first hinge portion 10 can comprise an elbow shape. More particularly, as depicted the first hinge portion can form a 90-degree angle, and define an "L" shape (as depicted). The first hinge portion 10 can also comprise a variety of other shapes and still perform at least some of the functions described herein. For example, in some embodiments the second support rod 3 can be sufficiently curved such that the first hinge portion 10 is substantially without a bend. It will be clear in light of the description herein that many other shapes and configurations are possible in accordance with the inventions.

As depicted, the first hinge portion 10 can include a first end 11 and a second end 12. The first end 11 can have a generally circular shape, but it will be clear from the disclosure herein that other shapes are possible. The shape of the first end 11 of the first hinge portion 10 can also generally match the shape of the second support rod 3, allowing easy attachment therebetween. For example, an end of the support rod 3 adjacent to the hinge assembly 7 can include a recess with a shape corresponding to the shape of the first end 11 of the first hinge portion 10. Thus, as depicted the recess can also have a generally circular cross-sectional profile. The recess can be sized to receive the first end 11 such that the first end 11 can be securely inserted into the recess of the second support rod 3. It will be clear from the disclosure herein that other shapes are possible. For example, if the support rod 3 is an I-beam, the first end 11 could include two tangs configured to engage one or more portions of, e.g., the center portion of the "I". As a further example, the shapes of the first end 11 and the second support rod 3 do not need to match, but could instead (or additionally) attach by other means such as by screwing the first hinge portion 10 onto threads on the second support rod 3, by passing screws/rivets through both the first hinge portion and the second support rod, and the like.

The first end 11 of the first hinge portion 10 can also include a pathway 13, depicted here as an elongated slot. The pathway 13 can be slightly larger than the tension member 6, allowing the tension member 6 to pass through the first hinge portion 10 with minimal frictional resistance. Although the pathway 13 can be fully enclosed (as depicted), in other embodiments the pathway can be fully or partially external. For example, in some embodiments the first hinge portion 10 can include an external groove configured to receive the tension member 6.

As depicted, the first hinge portion 10 can also include a pulley 14 positioned along the pathway 13. The pulley 14 can facilitate movement of the tension member 6 through the pathway 13, from the first end 11 to the second end 12. As shown, the pathway 13 can extend along a direction that is along or generally parallel to a longitudinal axis of the second support rod 3, and then follow a load bearing surface of the pulley 14 to extend generally parallel to the second end 12 of the first hinge portion 10. The pathway 13 can then be configured to align with a pathway 33 in the second hinge portion 30 when in a deployed position (as further described below).

In one embodiment, the umbrella assembly 1 has one or more features that prevent rotation in one configuration and permit rotation in another configuration. In some embodiments, when in the configuration where rotation is prevented, the umbrella assembly 1 can have one or more features that prevent rotation and translation in all but one direction, such as a translational direction as depicted in the figures. Moreover, movement in the one free translational direction can bring the depicted umbrella assembly 1 into another configuration in which further rotation and translation is permitted. As described herein, two sets of elements (sometimes referred to as locking mechanisms) provide a configuration preventing both translation and rotation as described. In one embodiment, one or more projections (e.g., projections 17) and one or more voids or slots (e.g., slot 36) are configured to mate to provide a locking mechanism. In one embodiment, one or more wedge-shaped recesses (e.g., recess 16) and one or more corresponding wedge-shaped projections (e.g., projection 37) are configured to mate to provide a locking capability. As described below, some portions of these locking mechanisms can be provided on the second end 12 of the first hinge portion 10.

At the second end 12, the first hinge portion 10 can define a generally prismatic shape. The second end 12 can include two lateral faces 20, an outer face 21, an inner face 22, and an end slot 23. The second end 12 can further include a pin-slot 15, a wedge-shaped recess 16, and one or more side projections 17. The side projection(s) 17 extend laterally from the lateral face(s) 20. The pin-slot 15 can generally align with the first hinge portion 10, or in more specific embodiments be oriented generally parallel to a longitudinal axis of the second end 12. As depicted, the pin-slot 15 extends from the lateral faces 20 and is generally parallel to the outer and inner faces 21, 22. However, in other embodiments the slot 15 can be curved, angled, and/or not in alignment with the faces 21, 22. Further, in some embodiments the pin-slot 15 can be completely enclosed by the lateral faces 20, and thus not span the lateral faces. As will be described further below, the shape of the pin-slot 15 can partially determine the movement of the second hinge portion 30.

The wedge-shaped recess 16, as depicted, defines a terminal portion of the second end 12, and in some embodiments defines a majority of the terminal portion. Further, the wedge-shaped recess 16 can generally span the end slot 23. The depth of the wedge-shaped recess 16 can gradually increase from an initial starting depth at a first location 24 to an end depth at a second location 25. In one embodiment, the second location 25 corresponds to the deepest portion of the recess 16. In one embodiment, the deepest portion of the recess 16 is near the pathway 13 and the outer face 21, and the shallowest portion of the recess 16 is near the inner face 22. The angle of the recess 16 can be chosen to allow a wedge-shaped projection 37 (described below) to slide into the recess 16 in operation. Further, the edges of the recess 16 can be sufficiently steep to prevent the second hinge portion 30 from rotating when the wedge-shaped projection 37 is inserted. As is described in greater detail below the engagement of the projection 37 and the recess 16 provides a locking mechanism that can enhance the security of the coupling between the umbrella assembly 4 and the rod 3. The projection 37 and recess 16 also provide a guiding function to enable the hinge portions 10, 30 to be engaged without misalignment or jamming.

Figure 2A:
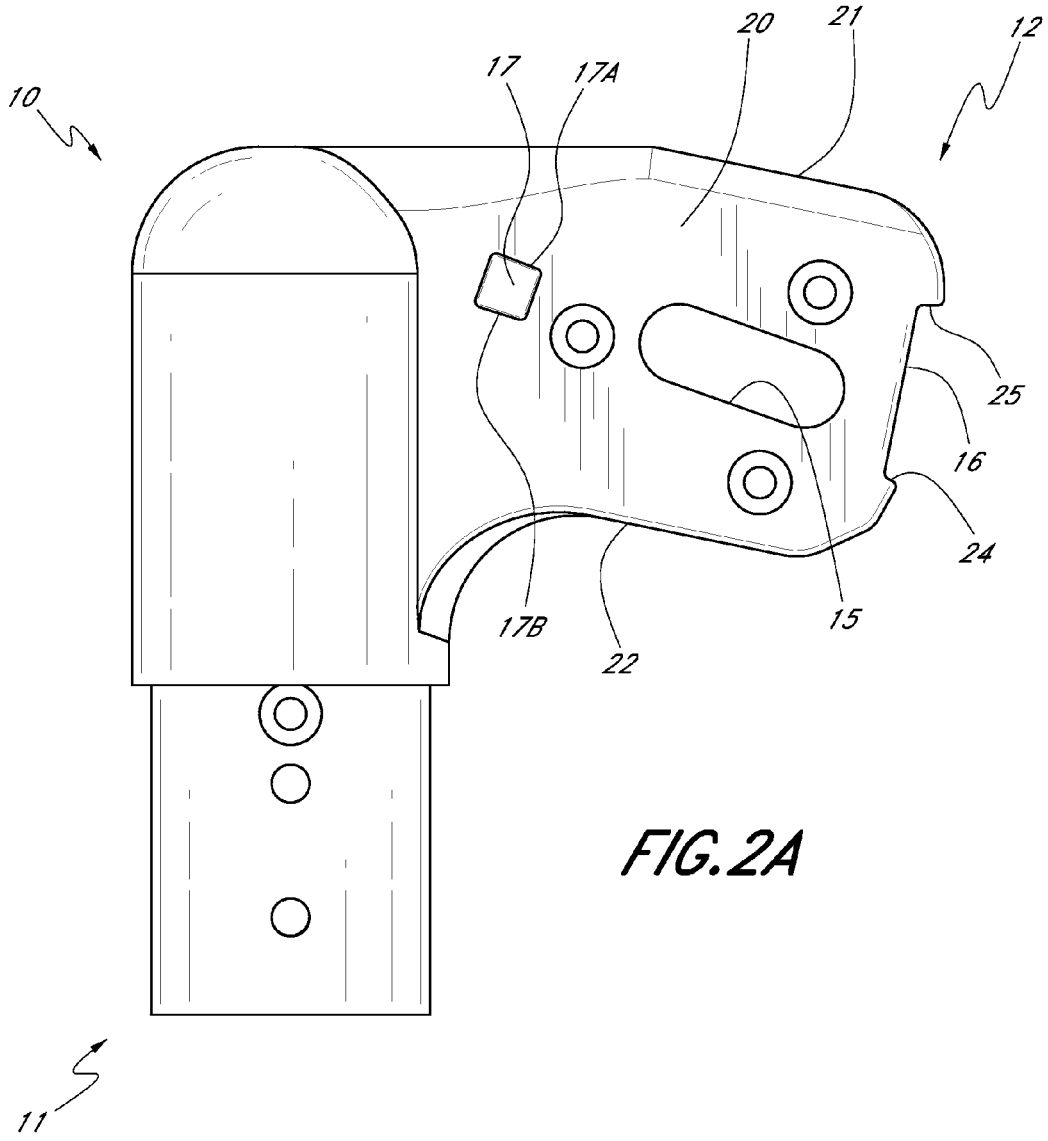
FIG. 2A depicts a side view of the first hinge portion of FIG. 2.

As discussed above, the first hinge portion 10 can also include one or more side projections 17. In some embodiments, the side projection(s) 17 can be generally angular. In more specific embodiments, the side projections 17 can take any suitable shape, for example, having an inner face 17*a* and an outer face 17*b* (see FIG. 2A). The inner and outer faces 17*a*, 17*b* can be substantially parallel to each other in some embodiments. In other embodiments, the inner and outer faces can be disposed at an angle with respect to each other, such that the side projection 17 is progressively narrower toward the side adjacent to the pin-slot 15. As depicted the projections 17 are cuboid-shaped projections that extend from the lateral faces 20. The projections 17 can be generally in alignment with the pin-slot 15. In one embodiment, the inner and outer faces 17*a*, 17*b* do not extend beyond projections of inner and outer aspects of the pin-slot 15. See FIG. 2A. It will be clear from the disclosure herein that other shapes may be used, as well as other positions of the projection(s) 17 to accomplish comparable functionalities. The projections can further be configured to interface with corresponding slots 36 on the second hinge portion 30 to generally limit and in some cases stop movement of the hinge assembly 7, described below.

The second end 12, as depicted in FIG. 3, can also include a curved portion 18 within the end slot 23. The curved portion 18 can coordinate with the pathway 13 to direct the tension member 6. When the hinge assembly 7 is in a position such as that in FIG. 6, the tension member 6 can extend from the pathway 13 onto the curved portion 18, eventually extending into the pathway 33 on the second hinge portion 30. As described above in relation to the pathway 13, the curved portion 18 may also be enclosed and/or external.

The pathway 13 and the curved portion 18 of the first hinge portion 10 can be configured to direct the tension member 6 into the pathway 33 of the second hinge portion 30. The second hinge portion 30, as depicted in FIG. 4, can have a generally forked shape, but other shapes are possible. Further, although as depicted the second hinge portion 30 and its pathway 33 are both generally straight, they can be curved, angled, or shaped in some other manner.

The second hinge portion 30 can include a first end 31 and a second end 32. The first end 31 can interact with the first hinge portion 10 and terminate at an upper face 43. The second end 32 can interact with the canopy assembly 4 and terminate at a lower face 44. As depicted, both the upper and lower faces 43, 44 can have generally semi-circular shapes facing in opposite directions and perpendicular to one another. More particularly, the faces 43, 44 can comprise one or more cylindrical faces comprising a constant radius of curvature centered on axes that would be perpendicular if projected into a plane perpendicular to a longitudinal axis of the hinge portion 30. As further described below, this orientation can allow the canopy assembly 4 to rotate in multiple directions. For example, this configuration enables rotation in a longitudinal plane (e.g., the plane in which the section 3-3 is disposed) due to the shape of the face 43 and in a lateral plane due to the shape of the face 44. Between the first and second ends 31, 32 the second hinge portion 30 can include lateral faces 41. Between the lateral faces 41 and interior to the tines 35 of the forked portion, the second hinge portion 30 can include interior ribbing 40. The tines 35 provide enhanced structural support adjacent to the face 43 while maintaining relatively low weight of the second hinge portion 30.

As depicted, the first end 31 has a fork shape with a pin 34 extending between the tines 35. The pin 34 is a strong structural remember that can support the weight of the hinge portion 30 and the canopy assembly 4 attached thereto. In one embodiment the pin 34 is generally centrally located between the tines 35. The pin 34 also can extend through the lateral faces 41 in some embodiments. The location of the pin 34 and other elements of the second hinge portion 30 can be arranged to allow operability with the first hinge portion 10. As will be discussed further below, in the depicted embodiment the pin 34 (along with the pin-slot 15 in the first hinge portion 10) allows the hinge assembly 7 to provide both translational and rotational freedom of movement. As discussed in regard to the pin-slot 15 above, the pin 34 need not extend completely through the second hinge potion 30. For example, in embodiments where the pin-slot 15 is separated into two distinct cavities on the lateral faces 20, the pin 34 can similarly be separated into two distinct inwardly projecting portions. Thus, in that embodiment two distinct and complementary pin-in-slot joints can be formed.

Figure 5A:
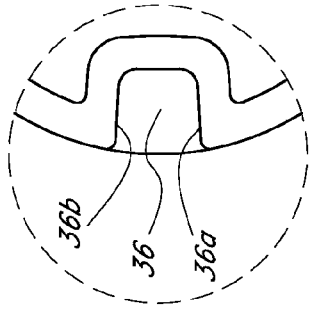
FIG. 5A is an enlarged detail view of the portion of the second hinge portion indicated at 5A-5A.
Figure 5:
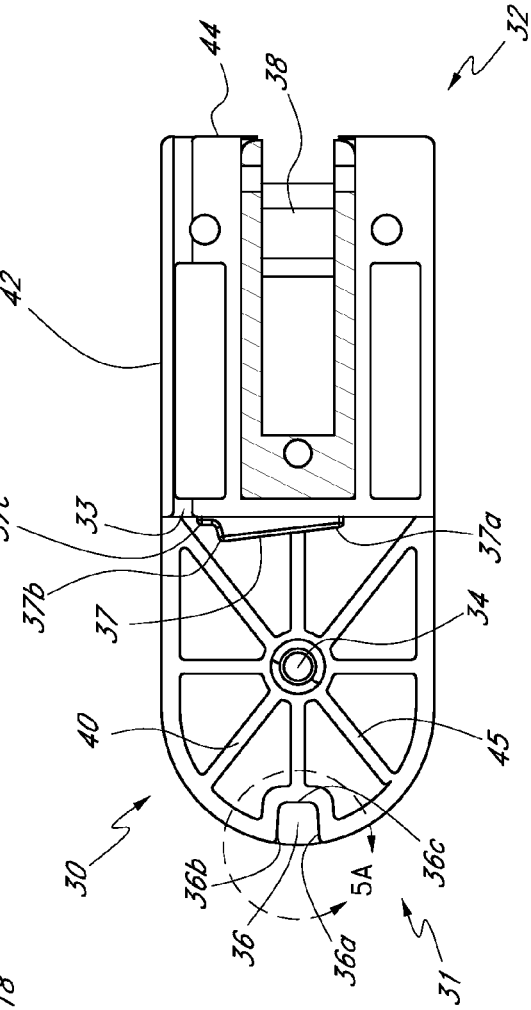
FIG. 5 depicts a cross-sectional view of the second hinge portion of FIG. 5 taken at section plane 5-5.

Referring back to the figures, the first end 31 of the second hinge portion 30 can include one or more slots 36. As depicted, the slots 36 can be disposed on the upper face 43, but other positions are possible. The slots 36 can be configured to receive the side projections 17 of the first hinged portion 10. The slots 36 can be recessed from the upper face 43 to a depth sufficient to at least partially, and sometimes to completely, receive the projections 17. Preferably, the shape of the slots 36 closely matches that of the side projections 17. In one embodiment, the slots 36 have inner and outer faces 36*a*, 36*b* that are spaced apart by a substantially constant distance along the depth of the slot 36. In one embodiment, the slots 36 define a first width at the face 43 and a second width between the face 43 and a bottom 36*c* of the slot 36, where the first width is no less than the second width. In one embodiment, the slots 36 define a void comprising a generally cuboid shape to match the general shape of the projections. As further depicted, one or both of the projections 17 (depicted, e.g., in FIG. 2) and slots 36 (depicted, e.g., in FIG. 5) can include beveled edges to facilitate interengagement.

The first end 31 can also include a projection 37 that is configured to engage a corresponding feature on the first hinge portion 10. In one embodiment, the projection 37 is wedge-shaped, which can facilitate engagement with the corresponding feature of the first hinge portion 10, as discussed below. In one embodiment, the projection 37 can be located generally between the tines 35. As depicted, the wedge-shaped projection 37 is disposed on an interior face 45 between the tines 35. The inner face 45 can further include an interior slot 46 disposed to be generally aligned with the end slot 23 on the first hinge portion 10. It will be clear from the disclosure herein that the wedge-shaped projection 37 may also reside elsewhere, and further may comprise other shapes.

As discussed above, the wedge-shaped projection 37 can be positioned to operably interact with the wedge-shaped recess 16 on the first hinge portion 10. Further, the wedge-shaped projection 37 can have a shape generally matching the shape of the wedge-shaped recess 16. For example, the wedge-shaped projection 37 can have an inner end 37*a* having a first height above the face 45 and an outer end 37*b* having a second height above the face 45. Similar to the wedge-shaped recess 16, the first height can be less than the second height. In further embodiments, the heights of the wedge-shaped projections 27 can generally match those of the wedge-shaped recess 16. The wedge-shaped projections can also include a trailing portion 37*c* adjacent the outer end 37*b*. The trailing portion 37*c* can have a reduced height sufficient to separate the first hinge portion 10 and second hinge portion 20 when in the position depicted in FIG. 9. Thus, the trailing portion 37*c* can provide additional clearance for the tension member 6.

The second end 32 of the second hinge portion 30 can include a canopy joint 38 configured to allow attachment to the canopy assembly 4. As depicted, the canopy joint 38 can provide an additional means for rotation, independent and perpendicular to the rotation between the first and second hinge portions 10, 30. The perpendicular orientation between the upper face 43 and the lower face 44 of the second hinge portion 30 can facilitate the additional freedom of rotation.

As further depicted, both the first and second hinge portions 10, 30 can comprise a generally two-piece construction. Each may comprise two mirror-pieces configured to come together to from the respective portions and be joined by connectors such as threaded and threadable connectors interengaging with through holes. The two-piece construction can facilitate construction of the hinge assembly.

Figure 6A:
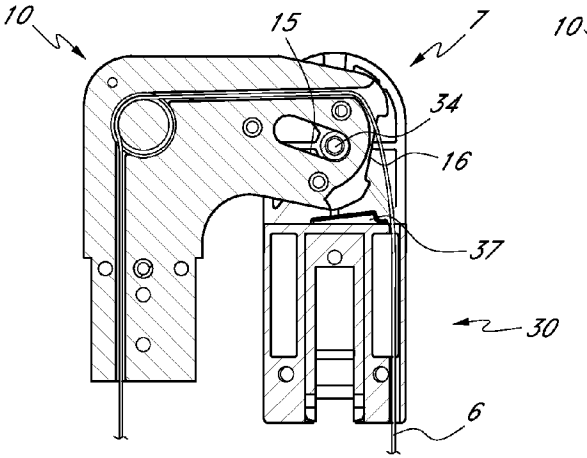
Figure 9A:
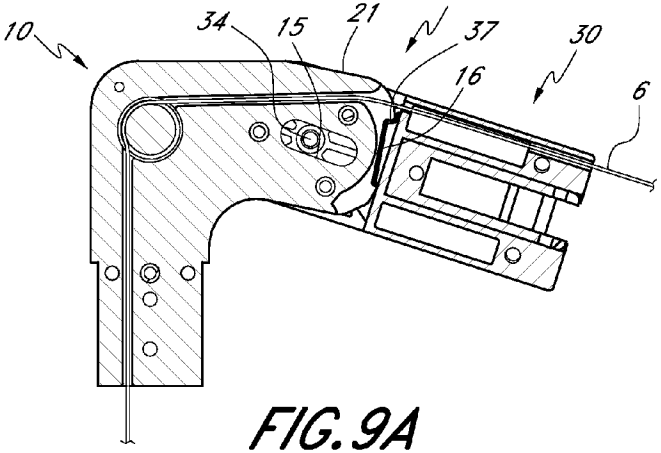
Figures 6B, 7B, 8B, 9B:
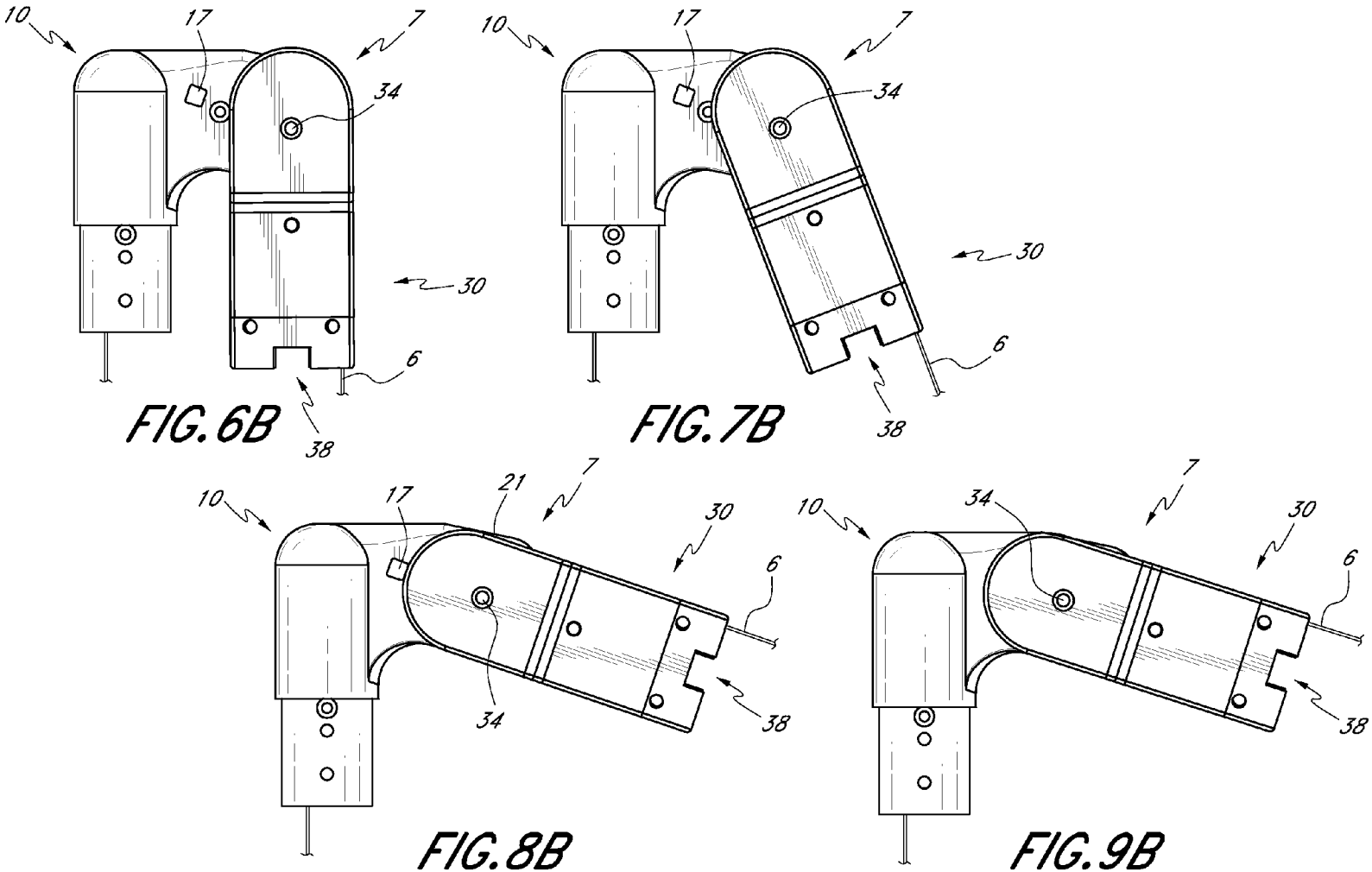

As depicted in FIGS. 6A-9C, the hinge assembly 7 can move from a folded position (depicted in FIG. 6A) to a deployed position (depicted in FIGS. 9A, 9B). Similarly, the canopy assembly 4 can move from a closed position to an open position. As depicted in FIGS. 6A, 6B, the hinge assembly 7 can start in a folded position. Further, the second support rod 3 can be withdrawn toward the first support rod 2 to be in a compact orientation. With the hinge assembly 7 folded, the wedge-shaped projections 37 can be withdrawn from the wedge-shaped recess 16, and the side projections 17 can be withdrawn from the slots 36. The pin 34 can be located in the pin-slot 15 such that the second hinge portion 30 is farthest away from the first hinge portion 10, and the second hinge portion is generally aligned with the first end 11 of the first hinge portion.

While in the compact orientation the canopy assembly 4 can hang straight down when in the folded position. As depicted, this can be the natural hanging position of the canopy assembly 4, and accordingly the tension member 6 can be loose. However, in other embodiments the hinge assembly may be held in a folded position where the canopy assembly 4 does not hang straight down or some other element (e.g. a spring or other motion limiting device or support) causes it to be positioned at some other angle. In such embodiments the tension member 6 can remain taut in the folded position (held for example by a knot or cleat nearer the base of the umbrella assembly 1), or alternatively another element can support the canopy assembly 4 (e.g. an additional tension member).

Figure 7A:
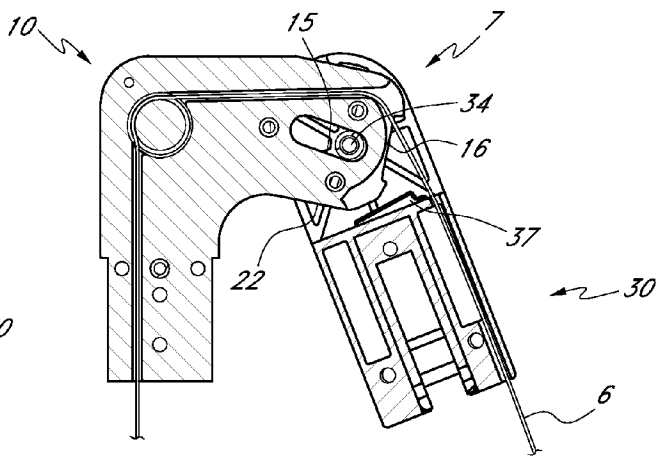
Figure 7C:
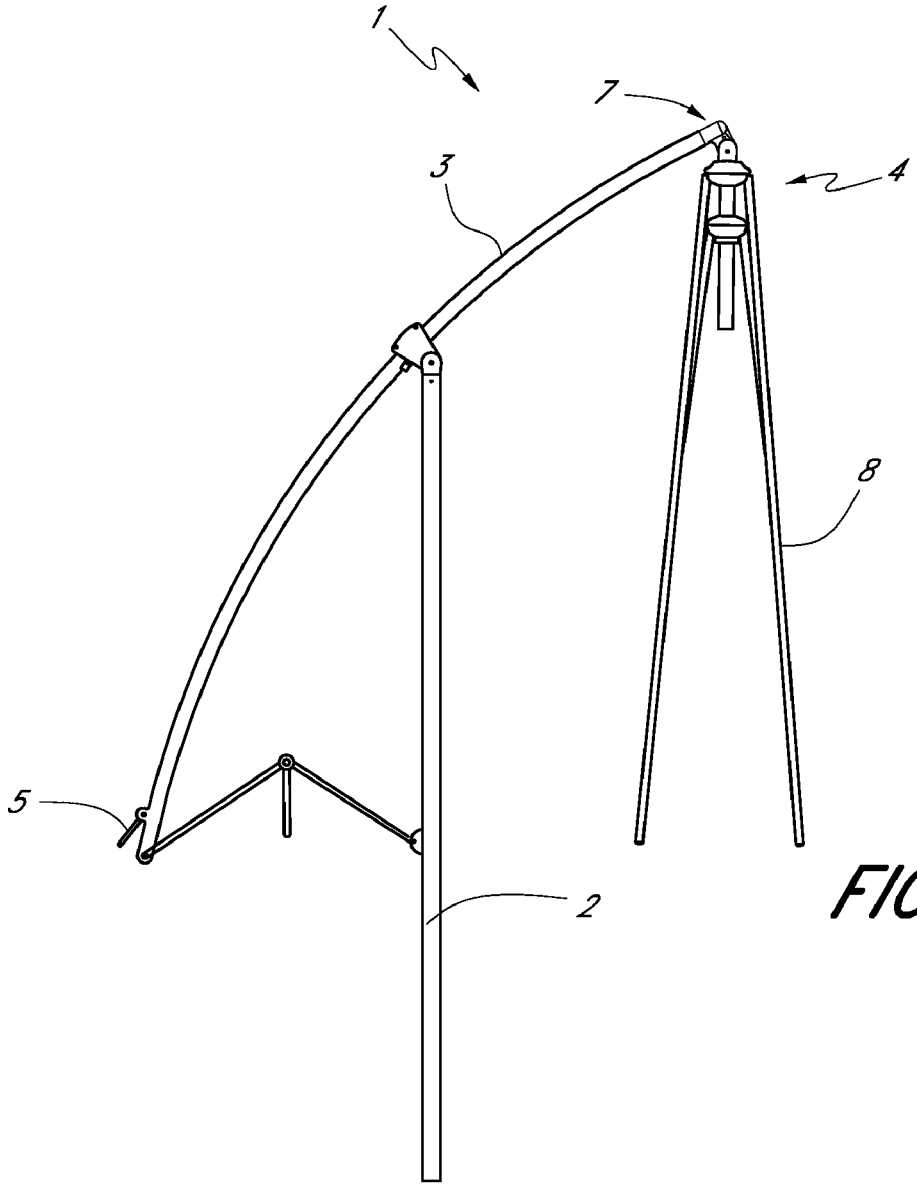

As depicted in FIGS. 7A, 7B, 7C (in comparison with FIGS. 6A-B, 8A-C, and 9A-C, the canopy assembly 4 can move with the hinge assembly 7 and the tension member 6. The force of gravity can cause the second hinge portion 30 to move toward alignment with the second end 12 of the first hinge portion 10, as the second support rod 3 extends. Alternatively, in some embodiments the hinge portion 30 can move toward alignment with increased tension in the tension member 6, for example if the hinge assembly 7 has sufficient frictional forces to prevent rotation by solely the force of gravity. Through this process, the tension member 6 can separate from the curved portion 18 and straighten, decreasing its length between the pathway 13 of the first hinge portion 10 and the canopy assembly 4 to which it can ultimately connect. This change in orientation can be accomplished through rotation about the pin 34 and/or the pin slot 15.

Notably, the action of the tension member 6 can also affect other elements of the umbrella assembly 1. For example, the tension member 6 can also actuate the canopy assembly 4 between open and closed positions. In the illustrated embodiment it may be desirable to keep the canopy assembly 4 closed until the hinge assembly 7 reaches a locked position. Accordingly, the canopy assembly 4 can have a resistance to opening greater than the force required to rotate and lift the hinge assembly 7 and canopy assembly 4. Thus, the tension in the tension member 6 can be too low to overcome the resistance of the canopy assembly 4 until the hinge assembly 7 reaches the position indicated in FIGS. 9A, 9B, 9C (further described below).

In other embodiments, it may be desirable to allow the canopy assembly 4 to open first, and then have it rotate with the hinge assembly 7. In such embodiments the resistance of the canopy assembly 4 can be less than the force required to rotate and lift the hinge assembly 7 and the canopy assembly 4. In further embodiments, the canopy assembly 4 can be configured to open at some intermediate stage of deployment of the hinge assembly 7. Notably, having the canopy assembly 4 open earlier in the movement of the hinge assembly 7 can facilitate use of the umbrella assembly 1 at varying angles.

Figure 8A:
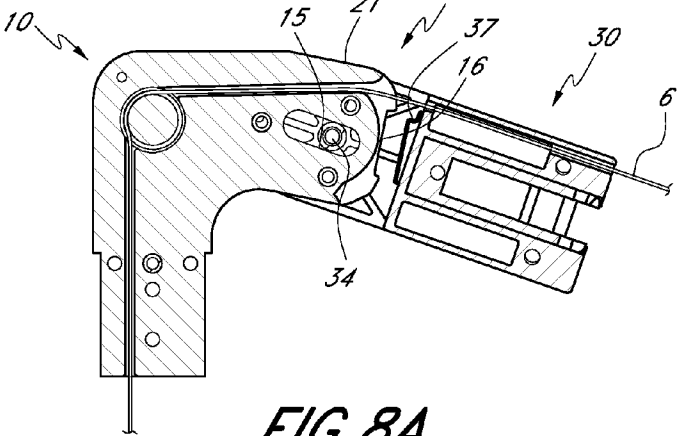
Figure 8C:
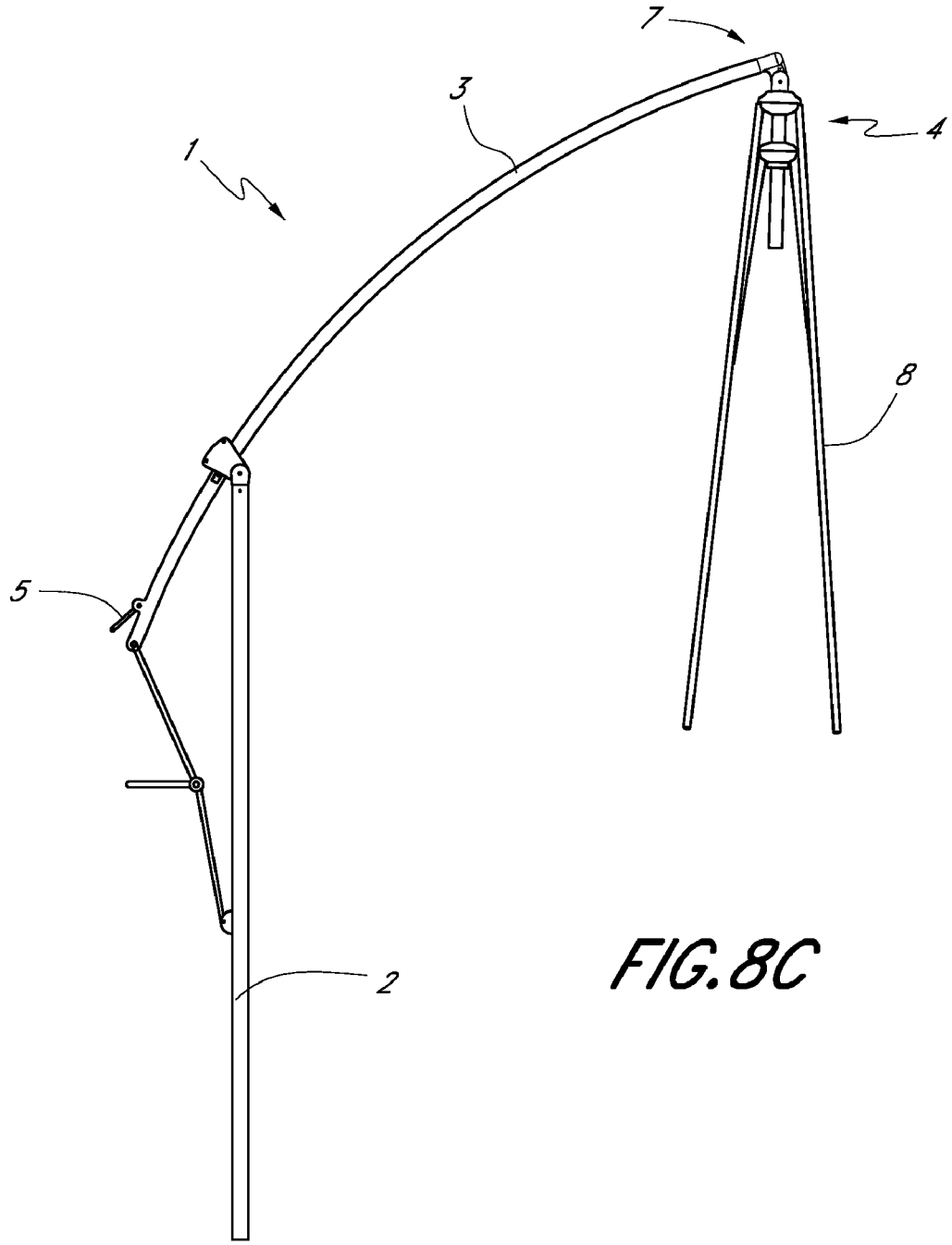

As depicted in FIGS. 8A, 8B, 8C, the second hinge portion 30 can advance toward the second end 12 of the first hinge portion 10 along the pin-slot 15. In the embodiment depicted the portions 10, 30 are generally in alignment. The upper face 43 of the first end 31 of the second hinge portion 30 and the wedge-shape of the projection and recess 16, 37 allow these components to easily slide into the interlocked position depicted in FIGS. 9A, 9B, 9C and further described below, despite possibly approaching out of alignment. Further, the bevels on the side projections 17 and the slots 36 can further facilitate alignment.

Figure 10:
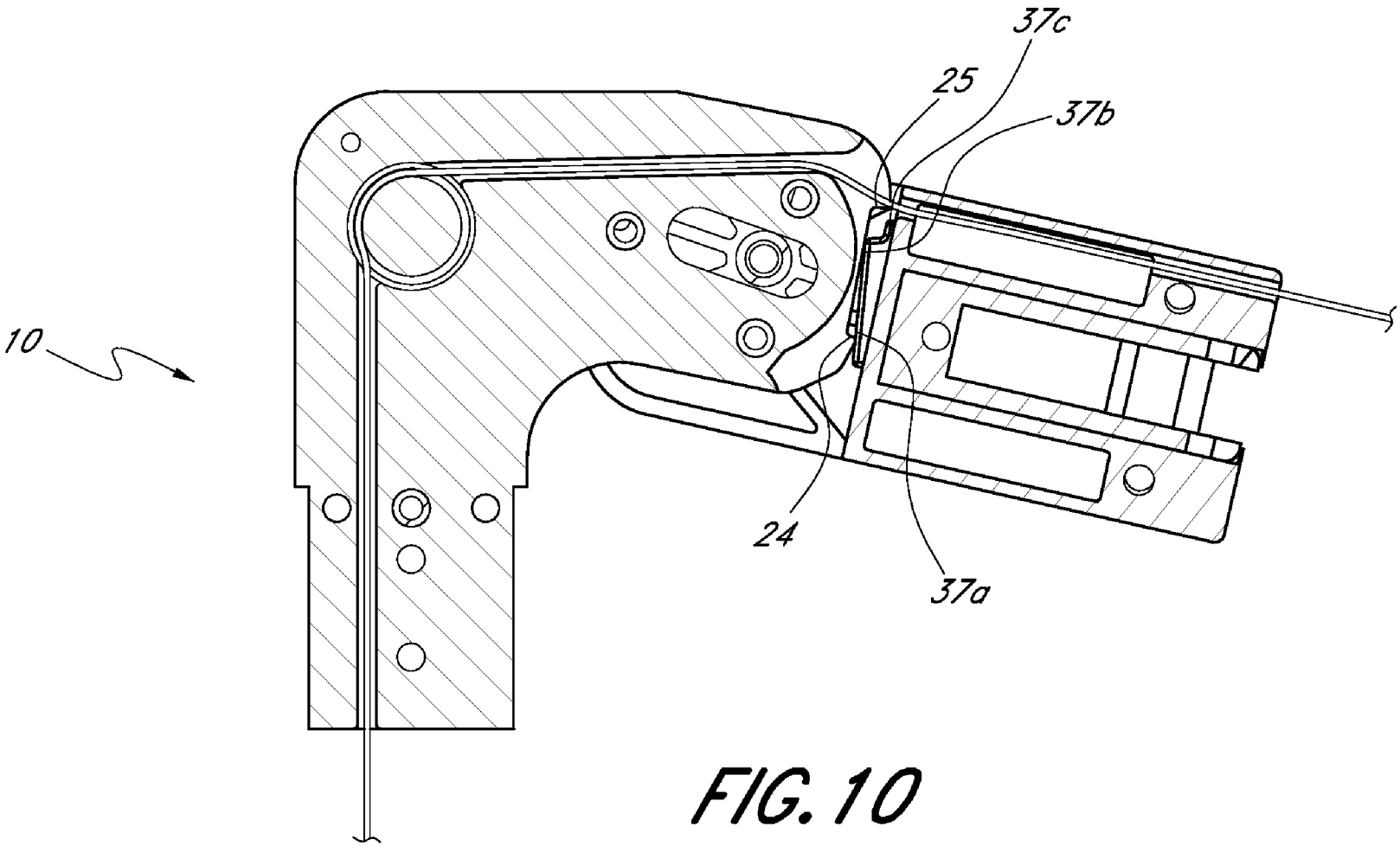
FIG. 10 depicts a position of the hinge assembly of FIG. 1A just prior to full engagement of the hinge assembly in a deployed position.

In some embodiments, as depicted in FIG. 10, the weight of the canopy assembly 4 can be sufficient to hold the second hinge portion 30 off-angle from the first hinge portion 10 when in a similar position as FIGS. 8A, 8B, 8C. In such embodiments, the first and second hinge portions 10, 30 can approach out of alignment. In such embodiments the shape of the wedge-shaped projection 37 and recess 16 can then guide the hinge portions into alignment. As depicted in FIG. 10, the wedge-shaped projection 37 slides into the recess 16 with the outer end 37*b* first. The outer end 37*b* can slide toward a matching portion at the second location 25 of the recess 16. The first location 24 of the recess 16 can meanwhile support the projection 37 until it meets the inner end 37*a*.

In other embodiments, the second support rod 3 can be extended out during the stage depicted in FIGS. 8A, 8B, 8C such that the second end 12 of the first hinge portion 10 is directed downward. In such embodiments the weight of the canopy assembly 4 can cause the hinge assembly 7 to rotate such that the second hinge portion 30 is oriented vertically. In some of these embodiments it may be preferable to replace the wedge-shapes and bevels with more angular surfaces, such as tight-fitting straight-edged projections at the first end 31 of the second hinge portion 30 and corresponding structure on the first hinge portion 10. Accordingly, a tighter and more robust fit can be provided.

Figure 9C:
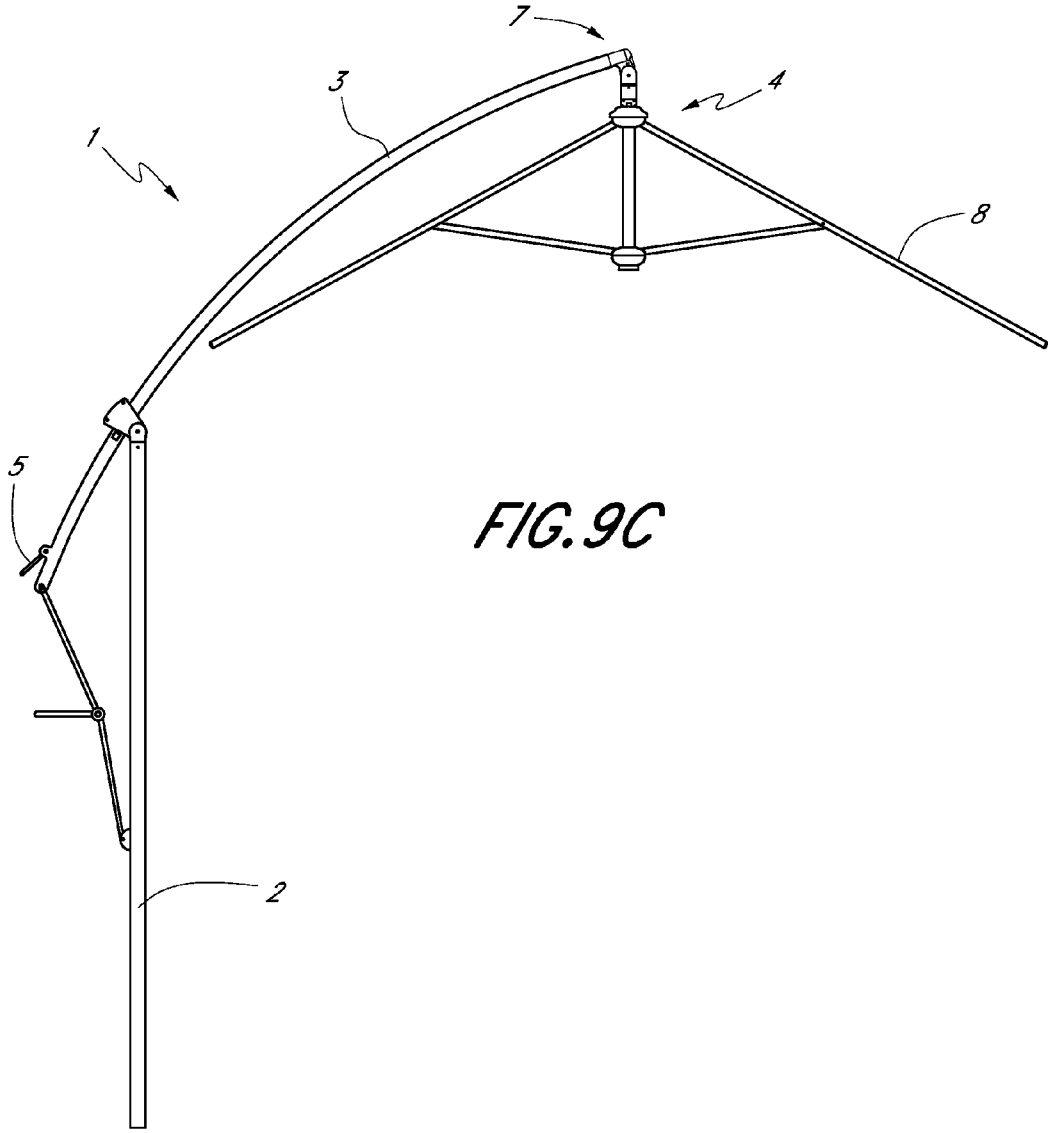

As depicted in FIGS. 9A, 9B, 9C, the first hinge portion 10 can be in a locked position and the canopy assembly 4 can be in a deployed position. As depicted, the wedge-shaped features 16, 37 have slid (in other embodiments they may enter without sliding) into each other, as have the side projections 17 and slots 36 (not shown). Further, in some embodiments the pin 34 can be at an end of the pin-slot 15 bringing the second hinge portion 30 closest to the first hinge portion 10. The interaction of the two distinct self-limiting connections (the wedge-shaped features 16, 37 and the projections 17 and slots 36) can each independently prevent any rotation of the hinge assembly 7, and only allow translational movement out of the locked position, which can be resisted by the tension member 6. The location of the pin 34 at the end of the pin-slot 15 can further restrict translational movement.

As depicted, when the hinge assembly 7 is in the locked position the canopy assembly 4 can be opened by continuing to apply tension to the tension member 6. The continued tension can force the struts to flex outward, pulling open the canopy fabric. Additionally, the second support rod 3 can be extended out, allowing the canopy assembly 4 to hang a distance from the first support rod 2. The extension of the second support rod 3 can also change the angle of the canopy assembly 4, as depicted. Further, by providing a rotatable canopy joint 38 at the second end 32 of the second hinge portion 30, the canopy assembly 4 can have a second degree of rotational freedom independent of the rotation between the first and second hinge portions 10, 30.

Although the foregoing description of the preferred embodiment of the present invention has shown, described, and pointed out the fundamental and novel features of the invention, it will be understood that various omissions, substitutions, and changes in the form of the detail of the apparatus as illustrated, as well as the uses thereof, may be made by those skilled in the art without departing from the spirit of the present invention.

What is claimed is:

1. An umbrella assembly comprising:

a cantilevered beam;

an elbow comprising an upper potion coupled with the cantilevered beam and a lower portion, the lower portion defining a pathway therethrough and comprising a pin-slot;

a fork comprising first and second tines disposed adjacent to opposite sides of and rotatably and translationally coupled to the lower portion of the elbow by a pin disposed between said tines and within said pin-slot, said fork defining a pathway therethrough; and a locking device for limiting the translation and rotation of the fork relative to the elbow, the locking device comprising:

a stop projection disposed on the lower portion of the elbow;

a stop projection receiving portion disposed on the fork that aligns with the stop projection when the pathways are aligned;

a wedge shaped recess disposed on the lower portion of the elbow; and a wedge-shaped projection disposed on the fork that aligns with the wedge-shaped recess when the pathways are aligned;

an elongated pulling member passing through the pathways of the elbow member and the fork; and a canopy assembly coupled with an end of the pulling member, wherein translation of the pulling member actuates the canopy assembly from a closed position to an open position and moves the stop projection into the stop projection receiving portion and moves the wedge shaped projection into the wedge-shaped recess to engage the locking device.

2. The umbrella of claim 1, wherein:

the canopy assembly is coupled to the fork, translation of the elongated pulling member reversibly opens the canopy assembly, further translation of the elongated pulling member reversibly rotates the fork such that the pathways align, and yet further translation of the elongated pulling member causes the fork to translate until the wedge-shaped recess and the stop projection receiving portion engage the stop projection and the wedge-shaped projection respectively such that the umbrella canopy is in a locked extended position.

3. An umbrella assembly comprising:

a cantilevered beam;

a first hinge member comprising a projection extending horizontally and laterally with respect to the umbrella assembly;

a second hinge member coupled with the first hinge member, comprising a void that has a shape corresponding to that of the projection and that faces the projection;

wherein at least one of the first and second hinge members are operably coupled to the cantilevered beam, and wherein the umbrella assembly has a first position in which the projection and the void are disengaged permitting relative movement between the first and second hinge members and a second position in which the projection and the void are engaged preventing such relative movement.

4. The umbrella assembly of claim 3, wherein the projection is received within the void when the first and second hinge members are in the second position.

5. The umbrella assembly of claim 3, wherein the projection is disposed on a surface that is exposed at least when the first and second hinge members are in the first position.

6. The umbrella assembly of claim 3, wherein at least one of the first and second hinge members further comprises a recess and the other of the first and second hinge members comprises a projection that generally matches the shape of the recess.

7. The umbrella assembly of claim 6, wherein the recess and the projection that generally matches the shape of the recess are ramp-shaped.

8. The umbrella assembly of claim 3, wherein the projection and the void, when engaged, only allow translation.

9. The umbrella assembly of claim 3, wherein the first and second hinge members are rotatably and translationally coupled.

10. The umbrella assembly of claim 9, wherein the first and second hinge members are rotatably and translationally coupled by a pin and slot joint.

11. The umbrella assembly of claim 3, wherein the projection and void, when engaged, permit a canopy coupled with the second hinge member to maintain a fixed angular relationship with the cantilevered beam in a variety of positions of the cantilevered beam.

12. An umbrella assembly comprising:

a cantilevered beam;

a first hinge member comprising a projection extending laterally with respect to the umbrella assembly, wherein the projection has a generally cuboid shape;

a second hinge member coupled with the first hinge member, comprising a void that has a shape corresponding to that of the projection and that faces the projection;

wherein at least one of the first and second hinge members are operably coupled to the cantilevered beam, and wherein the umbrella assembly has a first position in which the projection and the void are disengaged permitting relative movement between the first and second hinge members and a second position in which the projection and the void are engaged preventing such relative movement.

13. The umbrella assembly of claim 12, wherein the void has a generally cuboid shape.

14. A cantilevered umbrella assembly comprising:

a cantilevered beam;

a canopy assembly coupled with the cantilevered beam; and a joint disposed between the canopy assembly and the beam and allowing both translational and rotational movement of the canopy assembly relative to said beam between a locked position and an unlocked position, wherein the joint is stabilized in the locked position by at least two locking mechanisms, each having distinct structure, that both limit rotation and that both limit translational movement to only one direction.

15. The umbrella assembly of claim 14, further comprising a tension member passing through the joint and attached to the canopy assembly, the tension member transmitting a force to open the canopy assembly and engage the locking mechanisms.

16. The umbrella assembly of claim 14, wherein the joint comprises a pin and slot joint.

17. The umbrella assembly of claim 14, wherein one of the locking mechanisms comprises a lateral projection disposed on a first portion of the joint and a void disposed on a second portion of the joint, the void being positioned between the canopy assembly and the lateral projection when the locking mechanisms are not engaged.

18. The umbrella assembly of claim 17, wherein the lateral projection comprises an end closest to the void having a projection perimeter, the void having an end closest to the projection having a void perimeter, the void perimeter being greater than the projection perimeter.

19. The umbrella assembly of claim 14, wherein one of the locking mechanisms comprises two lateral projections and two corresponding voids, the projections and voids being disengaged in a first position where the canopy assembly is spaced from the cantilevered beam by a first amount and engaged in a second position when the canopy assembly and the cantilevered beam are separated by a second amount less than the first amount.

20. The umbrella assembly of claim 14, wherein one of the locking mechanisms comprises a ramp-shaped projection and a ramp-shaped recess, the ramp-shaped portion and ramp-shaped recess being spaced from each other when the canopy assembly is not fully opened, the ramp-shaped portion being received in the ramp-shaped recess when the canopy assembly is fully opened.

21. The umbrella assembly of claim 14, wherein the two locking mechanisms operate in distinct ways.

22. A cantilevered umbrella assembly comprising:

a cantilevered beam;

a canopy assembly coupled with the cantilevered beam; and a joint disposed between the canopy assembly and the beam and allowing both translational and rotational movement of the canopy assembly relative to said beam between a locked position and an unlocked position, wherein the joint is stabilized in the locked position by at least two distinct locking mechanisms that both limit rotation and that both limit translational movement to only one direction, wherein one of the locking mechanisms comprises a lateral projection disposed on a first portion of the joint and a void disposed on a second portion of the joint, the void being positioned between the canopy assembly and the lateral projection when the locking mechanisms are not engaged, wherein the lateral projection comprises a cuboid shape.

* * * * *

UNITED STATES PATENT AND TRADEMARK OFFICE

CERTIFICATE OF CORRECTION

PATENT NO. : 8,066,021 B2
APPLICATION NO. : 12/365746
DATED : November 29, 2011
INVENTOR(S) : Oliver Joen-an Ma It is certified that error appears in the above-identified patent and that said Letters Patent is hereby corrected as shown below:

1. On Title Page 2, Item 56, Line 18, Change "0/1911" to --9/1911--.
2. On Title Page 2, Item 56, Line 34, Change "Centilever" to --Cantilever--.
3. On Title Page 2, Item 56, Line 35, Change "Notice of Allowance" to --U.S. Appl. No. 11/134,074 Notice of Allowance--.
4. At Column 2, Line 29, Change "assembly" to --assembly.--.
5. At Column 7, Line 67, Change "potion" to --portion--.
6. At Column 11, Line 16, Change "potion" to --portion--.
7. At Column 11, Line 48, Change "The umbrella of claim 1" to --The umbrella assembly of claim 1--.

Signed and Sealed this
Tenth Day of July, 2012

David J. Kappos

David J. Kappos
*Director of the United States Patent and Trademark Office*